US006132347A

United States Patent [19]

Alessandri

[11] Patent Number: 6,132,347

[45] Date of Patent: Oct. 17, 2000

[54] PHYSICAL TRAINING MACHINE WITH ATTITUDE ADJUSTMENT

[75] Inventor: Nerio Alessandri, Longiano, Italy

[73] Assignee: Technogym S.r.l., Gambettola, Italy

[21] Appl. No.: 09/115,912

[22] Filed: Jul. 15, 1998

[30] Foreign Application Priority Data

Jul. 15, 1997 [IT] Italy ..... BO97A0427

[51] Int. Cl.[7] ..... A63B 21/62

[52] U.S. Cl. ..... 482/134; 482/38; 482/140; 482/104

[58] Field of Search ..... 482/100, 95, 96, 482/908, 137, 145, 104, 142, 134, 38

[56] References Cited

U.S. PATENT DOCUMENTS

| | | | |
|---|---|---|---|
| 3,858,873 | 1/1975 | Jones | 482/137 |
| 5,322,489 | 6/1994 | Webb et al. . | |
| 5,352,171 | 10/1994 | Lin | 482/96 |
| 5,403,151 | 4/1995 | Belsito et al. . | |
| 5,580,340 | 12/1996 | Yu | 482/96 |
| 5,658,227 | 8/1997 | Stearns | 482/96 |
| 5,669,865 | 9/1997 | Gordon | 482/142 |
| 5,733,229 | 3/1998 | Dalebout et al. | 482/96 |

FOREIGN PATENT DOCUMENTS

| | | |
|---|---|---|
| 94 11 573 | 3/1994 | Germany . |
| 296 13 749 | 1/1997 | Germany . |
| 2 314 029 | 12/1997 | United Kingdom . |

*Primary Examiner*—Jerome Donnelly
*Attorney, Agent, or Firm*—Pillsbury Madison & Sutro LLP

[57] ABSTRACT

The invention relates to a physical training machine with attitude adjustment, of the type comprising at least a posture portion and an implement portion; the posture portion is provided with means able to allow a user to be positioned in an exercise configuration wherein the user him/herself is set to perform a physical training exercise; the implement portion is provided with action means, accessible to the user when he/she is positioned in exercise configuration and employable by him/her for the application of a force able to contrast, for the execution of the exercise, a resistance offered by the physical training machine; the physical training machine comprises means for adjusting the relative position between the posture portion and the implement portion acting on one thereof and connecting means, positioned and acting between the posture and the implement portions able to modify the position of one of the portions as derived by the change in position of the other one of said portions.

10 Claims, 3 Drawing Sheets

PHYSICAL TRAINING MACHINE WITH ATTITUDE ADJUSTMENT

BACKGROUND OF THE INVENTION

The present invention relates to a physical training machine with attitude adjustment, i.e. a physical training machine whose attitude can be varied according to the anthropometric characteristics of the user and/or to the exercises the user is to perform on the machine.

For the execution of physical training activities such as, for instance, physical fitness exercises of various kinds, in gymnasiums, in physical rehabilitation centers and in similar structures, implements of the traditional kind, such as bars and dumb-bells, have been integrated by more physical fitness machines that are more complex and correlated to their use.

The latter comprise a basic frame whereto are associated means for imparting a force by the user, such as a bar or handles or levers, connected to a load which provides a resistance to the imparted force.

The user is positioned on a seat or a support (for instance a bench, a saddle or other supports) and from this position he/she performs a series of exercises aimed at the type of sporting or rehabilitative activities carried out.

Currently the seat can be adjusted, for instance in height, by the user to modify suitably the distances between seat and bar or handles. Such adjustment is essentially manual and it needs to be performed each time in correspondence with a change of exercise or with a change of user.

This characteristic can considerably impact on the beneficial effects of the exercises in that, to obtain a correct execution, it is necessary adequately to position the seat (or other similarly adjustable parts of the machine, such as the levers) according to the anthropometric measures of the subject. For this reason it may be necessary for an instructor to follow step by step the various phases of a training session to explain to the user how to maintain a correct posture during the execution of the exercises. This also holds in case of execution, by the same user, of different exercises with the same machine.

Moreover, the operation of manually adjusting the seat or other parts of the physical fitness machine may be found annoying, especially if one considers that gymnasium activities generally present a recreational and entertainment character.

In some physical fitness machines such as, for instance, the machines known in the technical jargon of the sector as vertical, chest-triceps-shoulder-press, pectoral machine, pullover, and others, an activating device, usually a pedal, able to arm the machine, is provided.

In other words, such machines comprise an implement portion, provided with bars, dumb-bells, or similar means for imparting a force, connected to a mass defining the resistance offered by the machine. The user's interaction with the implement portion, i.e. the user's gripping such means, is subordinated to the activation of the aforesaid pedal device which brings, thanks to the force imparted by the user on the pedal itself, the implement portion from a waiting position to an exercise position, wherein the user can grip the dumb-bell, the handles or the other similar means.

A drawback of machines comprising this type of pedal device relates to the fact that such device is essentially set fixedly, on a standard position essentially corresponding to a user of "average" height; in practice, regardless of the user's height, the pedal device is set in the same way: this can cause inappropriate movements by the persons who do not fall within the dimensional characteristics for which the device is designed. In any case, regardless of the user's height, it is possible for the athlete's approach to the machine to be found uncomfortable due to the impossibility of performing the aforesaid adjustments.

SUMMARY OF THE INVENTION

The object of the present invention therefore is to eliminate the aforementioned drawbacks with a physical training machine which allows to position the machine in its configuration best suited for the execution of an exercise in an essentially automatic manner, using appropriate control organs provided on the machine itself, able to be activated directly by the user (or by an instructor or another person so tasked) and able to position in an automatic manner a portion of the physical training machine in correspondence with the positioning of another portion of the machine itself.

In other words, with the present invention, the positioning of a first portion of the machine results from the positioning performed on another portion of the machine, appropriately connected to the first; in practice, at least two portions of the machine are mutually constrained by a kinematic connection which, as a result of the displacement of a first portion, determines the displacement of at least a second portion connected to the first.

The movement of the first portion, or main movement, can be interlocked to motorisation means (comprising, for instance, an electric motor positioned in correspondence with the seat) which, moving the first portion, thereby position the second one, whose motion thus is a function of the movement of the first one. Hence, there is the characteristic of linking together two or more variables related to portions of the machine thanks to a constraint relationship which is expressed in the connection existing between the portions themselves.

BRIEF DESCRIPTION OF THE DRAWINGS

The technical characteristics of the invention, according to the aforesaid purposes, can be clearly noted from the content of the claims reported below and the advantages thereof shall become more readily apparent in the detailed description that follows, made with reference to the accompanying drawings, which represent an embodiment provided purely by way of non limiting example, wherein:

DESCRIPTION OF THE PREFERRED EMBODIMENTS

Figure 1:
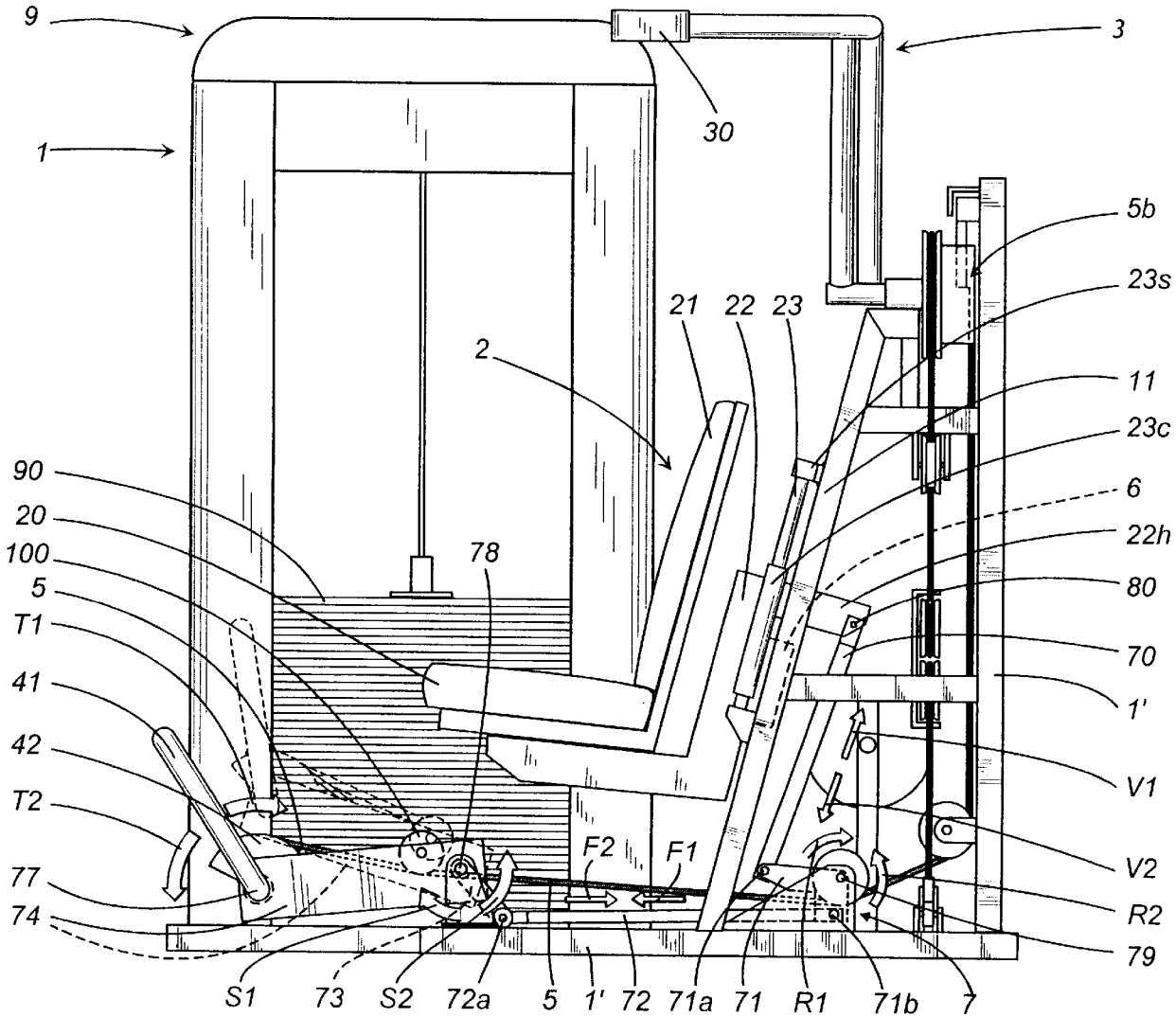
FIG. 1 shows, in a schematic side view, with some parts removed to highlight others, a possible embodiment of a physical training machine in accordance with the present invention.

In the accompanying drawings, the number 1 has been assigned to a physical training machine in its entirety.

The physical training machine 1 with attitude adjustment comprises at least one posture portion 2 and one implement portion 3 and 4, described hereafter.

The physical training machine comprises a base structure 1' able to support the aforesaid posture and implement portions.

The posture portion 2 comprises a seat 20, provided with a backrest 21 and supported by a support structure 22.

The base structure 1' of the physical training machine 1 presents a part 11 of its own frame essentially vertical and slightly inclined obliquely; on this portion 11 is constrained the support structure 22 of the seat, able to slide on two guides 23 which are parallel to each other and to the portion 11.

The guides 23 can be fastened to the portion 11 of the structure 1' through fastening means comprising devices of the type called "silent block" and indicated at 23, in order to make less rigid the coupling between the guides 23-support 22-seat 20 set and the base structure 1' and thereby to improve sliding by the seat along the guides 23.

The seat 20 can be moved vertically (directions V1 and V2 in FIG. 1) along the guides 23 and by means of coupling cylinders and pulleys 23*c*, thanks to motorization means 6 which can comprise, for instance, an electric motor acting on a worm screw connected on the support structure 22. The motorization of the seat 20 allows a user to vary the relative distance between the posture portion 2 and implement portion 3, 4 of the machine, according to the user's anthropometric values, to the exercise to be performed, or the like.

Obviously, motorization can be provided on another portion of the machine, allowing, in any case, to vary the relative distance between the aforesaid posture and implement portions.

The implement portion 3, 4 comprises action means 30, suitable for the execution of the exercise and comprising, for instance, handles, levers, bars or the like, connected to an element 9 able to provide a resistance.

In the example shown the resistance element 9 is of the gravitational type and it is represented by the so-called "weight pack", i.e. by a series of brick-shaped weights 90 sliding in related guides 91 and connected, through appropriate transmissions 93 to the implement portion 3. The implement portion 3, always with reference to the accompanying non-limiting figures, comprises two grip handles 30 supported by two angled arms 34 acting on corresponding pulleys 33 connected to the resistance element 9, through a cable 93*f*.

Figure 2:
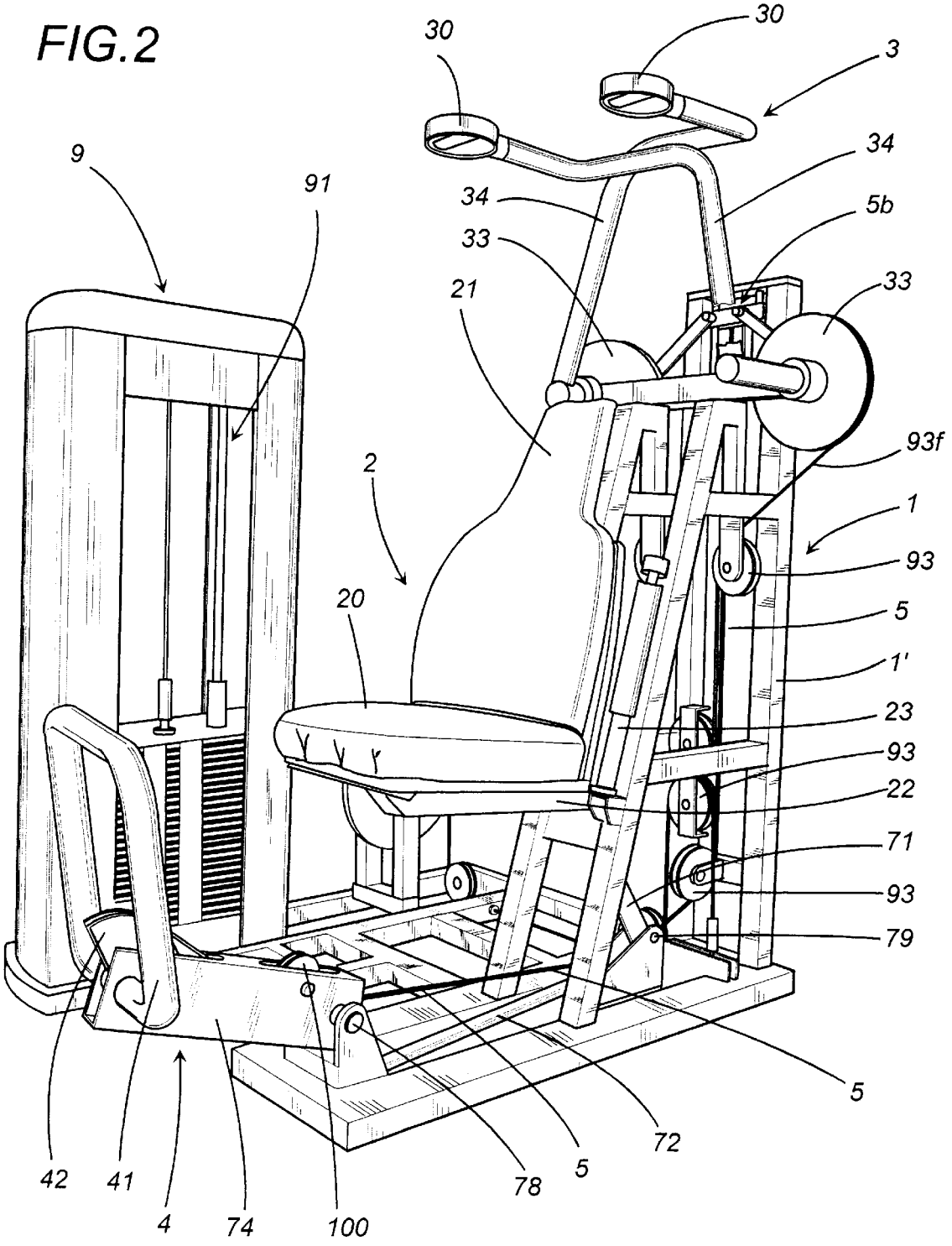
FIGS. 2, 3 show, in a perspective schematic view, the embodiment as per FIG. 1, in two different configurations.
Figure 3:
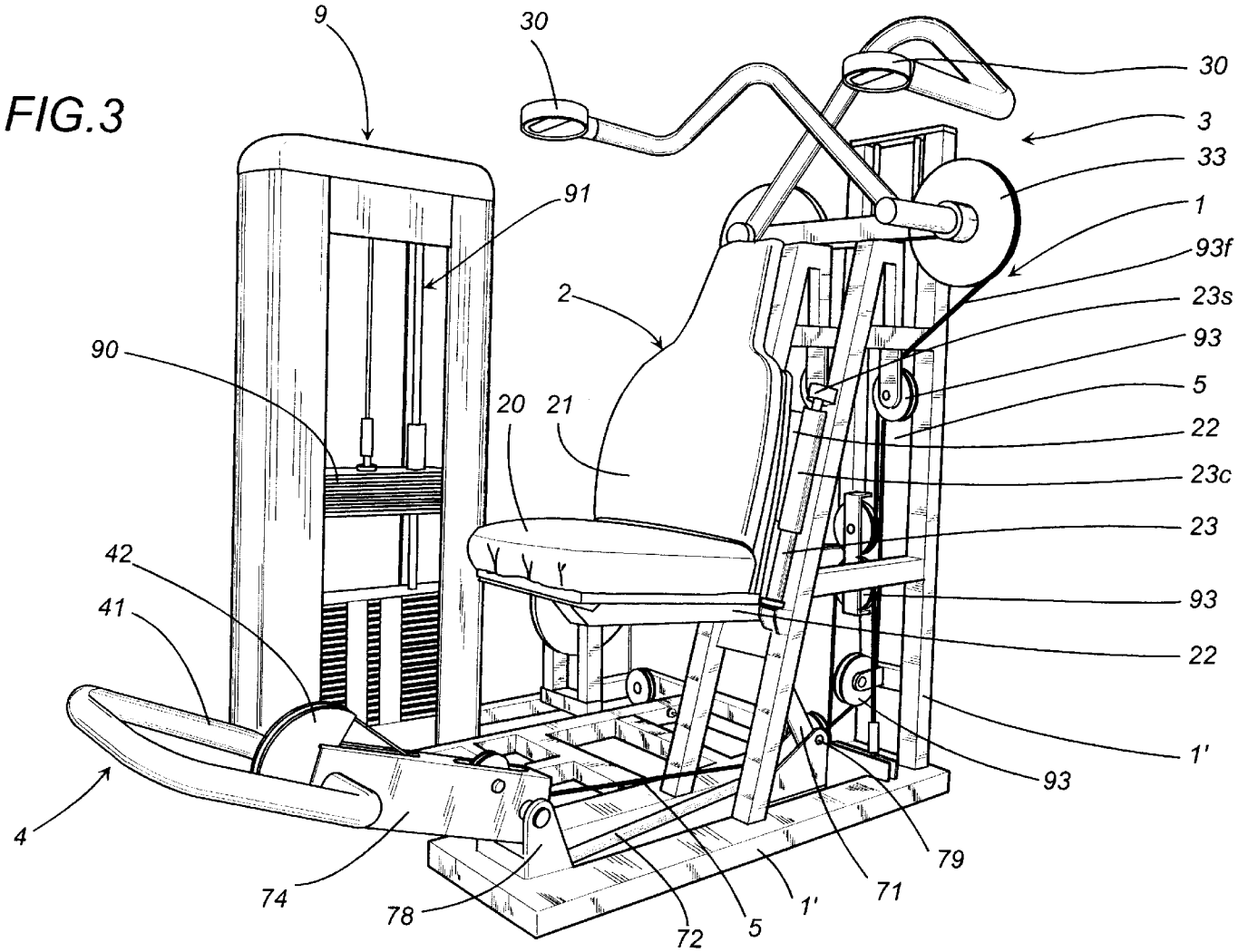

The implement portion 3, 4 further comprises means 4 for activating the action means 30, able to set the action means in a configuration suitable for the execution of an exercise, i.e. able to bring the action means themselves into a grip position reachable by the user. FIG. 2 shows a waiting configuration, wherein the action means 30 are positioned at such a height from the seat 20 as not to be easily reachable by the user. FIG. 3 shows the configuration assumed by the machine 1 after the (downward) action of the activation means 4, which place the handles 30 in a lowered position and make them accessible for the exercise.

The activation means 4 comprise a footrest 41, pivoting, in one of its ends, around a horizontal axis 77 and provided with an organ shaped as a circle portion 42 or winder, whereto is fastened one end of a cable 5, whose remaining end is fastened to a corresponding part of the action means 30 to activate the same, i.e. to bring the related arms 34 and the related handles in a position reachable by the user. The footrest 41, rotating around the axis 77 as a result of a pressure thereon imparted with direction T2 by the athlete, determines a corresponding displacement of the cable 5, able to "arm" the action means 30. The footrest, in order to allow a correct utilization of the machine, i.e. to be activated without erroneous movements, must be separated from the seat by a value that varies according to the dimensions of the person.

Advantageously, the activation means 4 are interlocked to the motion imparting means 6 which act on the seat 20 and are displaced as a result. In practice, as stated previously, since the ratio between the displacement of the seat 20 (vertical V1-V2) and the displacement of the footrest 41 in height must be correlated to the ratios which are functions of the anthropometric dimensions of the standard athletes, it is possible to connect the two portions of the machine kinematically, in order to obtain automatically the correct positioning between seat and footrest.

The particular connection (indicated as 7 in its entirety) used in the embodiment shown shall now be described in detail, without thereby limiting other possible realizations of the physical training machine with attitude adjustment constituting the subject of the invention.

To the support structure 22, and movable therewith, is connected a first rod 70 fastened, in a first end, to a projection 22*h* of the support structure 22 through a pin 80, in order to follow the support structure 22 itself in the upward movement V1 or downward movement V2.

At the bottom, the first rod 70 is hinged to a first lever 71, L-shaped and pivoting, in its junction portion, around a second pin 79, fixed with respect to the base structure 1'. The first lever 71 is connected, in its first end, in 71*a*, to the second end of the first rod 70. Following an upward displacement V1 of the first rod 70, a clockwise rotation R1 occurs of the first lever 71 around the pin 79, whilst for a downward displacement V2, the rotation shall be counter-clockwise R2.

To the second end of the first lever 71 is pivoted, in 71*b*, a first end of a second rod 72 which, in the example shown is positioned nearly horizontally. The clockwise rotation R1 of the first lever 71 shall determine a displacement F1 of the second rod 72 towards the footrest 41, vice versa a counter-clockwise rotation R2 shall determine a displacement F2 away from the footrest 41.

To the second end of the second rod 72 is pivoted, in 72*a*, a second lever 73. The second lever 73 is pivoted around a third pin 78, fixed with respect to the base structure 1'. The second lever 73 is rigidly connected (i.e. it constitutes a single body) with a third rod 74 positioned opposite to the fulcrum 78 and serving as a support base for the footrest 41. In practice, a displacement in direction F1 of the second rod 72 determines a clockwise rotation S1 of the second lever 73 and of the base 74, whilst a displacement F2 determines a counter-clockwise rotation S2 thereof.

The third rod 74 is positioned lowered (as shown in FIG. 1 in continuous lines) in correspondence with the maximum lowered position of the seat, whilst it will be raised (as shown schematically in dashed lines), when the height of the seat is raised. In this way, to displacements performed upstream (V1-R1-F1) corresponds a positioning of the footrest 41 itself in a configuration derived from the positioning of the posture portion 2.

In sum, when the seat 20 is displaced in height, a corresponding upward displacement of the footrest 41 occurs; for example, after a downward displacement V2 of the seat 20, a downward displacement of the first rod 70, a counter-clockwise rotation R2 of the first lever 71, a rightward displacement F2 of the second rod 72, a counter-clockwise S2 of the second lever 73-third rod 74 all take place.

The rotation of the footrest 41 allows, as stated previously, the activation of the implement portion 3; in correspondence with the third pivot 78 a device for the correction of the backlash can be provided, comprising in the example simply an idle roller 100 integral with the rod 74, able to compensate for the displacement of the footrest following the motion of the seat 20, thereby determining no changes in its modes of activation of the action means 30.

The invention thus conceived can be subject to numerous modifications and variations without thereby departing from the scope of the inventive concept. Moreover, all components can be replaced with technically equivalent elements; for instance, instead of the motion mechanism shown, comprising mechanical rods and levers, it is possible indifferently to use an electro-mechanical transducing mechanism, or the means for moving the seat 6 may be electrically correlated to corresponding means for rotating the rod 74, without thereby departing from the scope of the present invention.

What is claimed is:

1. A physical training machine with attitude adjustment, comprising:

a posture portion provided with a positioner, said positioner constructed and arranged to allow positioning of a user set to execute a physical training exercise;

an implement portion having an action accessible to said user when positioned in an exercise configuration, said action constructed and arranged to allow said user to apply a force in opposition to a resistance offered by the physical training machine;

an adjuster, constructed and arranged to adjust a relative position between said posture portion and said implement portion acting on one thereof; and a connector, positioned and acting between said posture and implement portions so as to modify the position of one of said portions in response to a change in position of the other one of said portions, wherein said connector comprises a plurality of extended members mutually constrained in such a way as to transmit, with a given transmission ratio, the motion related to a displacement of said posture position into a displacement of said activator, wherein said activator comprises a footrest pivoted on a first axis, said posture portion comprising a support structure for said user, movable with respect to a base structure through said adjuster and said connector comprises:

a first rod, fastened in a first end to said support structure;

a first lever, with its fulcrum around a second pin fixed with respect to said base structure and connected, in its first end, to the second end of said first rod;

a second rod, fastened in its first end to a second end of said first lever; and a second lever, fastened to the second end of said second rod and with its fulcrum around a third pin fixed with respect to said base structure, and connected to said footrest through a third rod supporting the same, angularly positioned with respect to said second lever in such a way as to make the displacements executed upstream on said posture portion, correspond to a rotation of said third rod suitable to position said footrest in a configuration derived from the positioning of said posture portion.

2. A physical training machine with attitude adjustment, comprising:

a posture portion provided with a positioner, said positioner constructed and arranged to allow positioning of a user set to execute a physical training exercise;

an implement portion having an action accessible to said user when positioned in an exercise configuration, said action constructed and arranged to allow said user to apply a force in opposition to a resistance offered by the physical training machine;

an adjuster, constructed and arranged to adjust a relative position between said posture portion and said implement portion acting on one thereof; and a connector, positioned and acting between said posture and implement portions so as to modify the position of one of said portions in response to a change in position of the other one of said portions, wherein said adjuster is motorized.

3. A physical training machine with attitude adjustment, comprising:

a posture portion provided with a positioner, said positioner constructed and arranged to allow positioning of a user set to execute a physical training exercise;

an implement portion having an action accessible to said user when positioned in an exercise configuration, said action constructed and arranged to allow said user to apply a force in opposition to a resistance offered by the physical training machine;

an adjuster, constructed and arranged to adjust a relative position between said posture portion and said implement portion acting on one thereof; and a connector, positioned and acting between said posture and implement portions so as to modify the position of one of said portions in response to a change in position of the other one of said portions, wherein said adjuster is connected to and acting in correspondence with at least said posture portion, and wherein said posture portion comprises at least one seat, said adjuster comprising a motorized translator constructed and arranged to translate bidirectionally said seat at least along a direction of approach to said implement portion.

4. A physical training machine with attitude adjustment, comprising:

a posture portion constructed and arranged to allow the positioning of a user in an exercise configuration wherein the user is set to execute a physical training exercise;

an implement portion provided with an action, the action being accessible to said user when positioned in exercise configuration and employable for the application of a force opposing a resistance offered by the physical fitness machine;

a positioner, constructed and arranged to position the action in a position reachable by said user;

an adjuster constructed and arranged to adjust the relative position between said posture portion, said implement portion, and the positioner, said adjuster being associated with one thereof;

connecting elements, positioned between said posture portion, said implement portion and said activator and acting thereon to modify the relative position of said posture portion, said implement portion and said activator, as derived from the change in position of one of said portions.

5. Physical training machine according to claim 4, wherein said adjuster is connected to and acting in correspondence with at least said posture portion.

6. A physical training machine according to claim 4, wherein said connecting elements comprise mechanical connectors for the transmission of motion.

7. A physical training machine according to claim 4, wherein said connecting elements comprise a plurality of levers or rods mutually constrained in such a way as to transmit, with a given transmission ratio, the motion related to a displacement of said posture portion into a displacement of said activator.

8. A physical training machine according to claim 7, wherein said activator comprises a footrest pivoted on a first axis, said posture portion comprising a support structure for said user, movable with respect to a base structure through said adjuster and said connector comprises:

a first rod, fastened in a first end to said support structure;

a first lever, with its fulcrum around a second pin fixed with respect to said base structure and connected, in its first end, to the second end of said first rod;

a second rod, fastened in its first end to a second end of said first lever; and a second lever, fastened to the second end of said second rod and with its fulcrum around a third pin fixed with respect to said base structure, and connected to said footrest through a third rod supporting the same, angularly positioned with respect to said second lever in such a way as to make the displacements executed upstream on said posture portion, correspond to a rotation of said third rod suitable to position said footrest in a configuration derived from the positioning of said posture portion.

9. A physical training machine according to claim 4, wherein said adjuster is motorized.

10. A physical training machine according to claim 4, wherein said adjuster is connected to and acting in correspondence with at least said posture portion, wherein said posture portion comprises at least one seat, said adjuster comprising a translator constructed and arranged to translate bidirectionally said seat at least along a direction of approach to said implement portion.

* * * * *